US005561926A

United States Patent [19]

Stratti

[11] Patent Number: 5,561,926

[45] Date of Patent: Oct. 8, 1996

[54] ARTICULATING MOUNTING ARRANGEMENT FOR EXCAVATOR

[76] Inventor: Samuel E. Stratti, 9 Nuwarra Road, Chipping Norton New South Wales 2170, Australia

[21] Appl. No.: 389,939

[22] Filed: Feb. 17, 1995

[51] Int. Cl.[6] ..... E02F 3/36

[52] U.S. Cl. ..... 37/468; 37/443; 414/694

[58] Field of Search ..... 37/403, 447, 444, 37/445, 468, 902, 903; 403/52, 53, 57, 58; 464/106 X, 112, 134, 136 X, 905 X; 414/718, 723, 694

[56] References Cited

U.S. PATENT DOCUMENTS

| | | | |
|---|---|---|---|
| 3,922,017 | 11/1975 | Cobb | 37/443 X |
| 4,077,140 | 3/1978 | Branconi | 37/443 |
| 4,304,520 | 12/1981 | Schmitz | 414/694 |
| 4,307,991 | 12/1981 | Bridwell et al. | 414/694 X |
| 4,906,161 | 3/1990 | Weyer | 37/403 X |
| 4,958,981 | 9/1990 | Uchihashi | 414/694 |
| 5,267,904 | 12/1993 | Geisthoff | 464/136 |
| 5,271,170 | 12/1993 | Mieger | 37/443 X |

*Primary Examiner*—Terry Lee Melius
*Assistant Examiner*—Robert Pezzuto
*Attorney, Agent, or Firm*—Davis and Bujold

[57] ABSTRACT

The present invention relates particularly to an articulating mounting for positioning a rock saw for cutting rock, in particular for the building industry.

Rock saw mountings are known which enable mounting of a rock saw blade to an hydraulic arm of a conventional excavator. Conventionally, the rock saw is mounted so it is fixed to either one side or other of the hydraulic arm. The angle of the rock saw relative to the hydraulic arm cannot be varied.

The present invention provides a mounting which enables three degrees of freedom of motion of the rock saw, to enable it to be fixed at predetermined angles to make predetermined desired angular cuts into rock. The rock saw may be moved from one side of the arm to the other in order to cut trenches without it being necessary to reposition the excavator.

The mounting may also be used as a support for tools other than a rock saw.

11 Claims, 4 Drawing Sheets

ARTICULATING MOUNTING ARRANGEMENT FOR EXCAVATOR

The present invention relates generally to an articulating mounting arrangement mounted or adapted to be mounted to the arm of an excavator or the like, for carrying a tool in any one of a plurality of predetermined orientations.

A conventional excavator comprises an excavator body and cab, where the operator sits, together with a hydraulic arm joined to the body. The hydraulic arm usually comprises two sets of beam arrangements articulated together at a knee joint, a first beam arrangement being joined to the body of the excavator by a further articulated joint and a second beam arrangement carrying at its opposite end to the knee joint a tool, such as a digger bucket. By hydraulically operating and pivoting the beam arrangements about the knee joint and the joint to the body, the arm can be extended away from the body, brought back towards the body, lifted, or lowered, all movement being in a single plane relative to the body. The number of orientations which a tool attached to the hydraulic arm is able to take up relative to the body is therefore limited and this can present difficulties in tool operation.

A rock saw, comprising a stone cutting blade mountable to the hydraulic arm of an excavator, is used for carrying out stone cutting work, for example for cutting trenches in stone. A rock saw tool used with a conventional excavator comprises a mounting at the end of a hydraulic arm which supports a rock saw blade and a drive motor for rotating the blade. Conventional rock saw mountings fix the blade to one side or other of the hydraulic arm. The blade is therefore generally fixed in a vertical plane with respect to the hydraulic arm. To cut away a desired section of rock using this tool it is often necessary to reposition the entire excavator a number of times. Some tasks are unable to be achieved with an excavator with this type of mounting and specialised equipment must be used. For example, to cut away a large section of cliff presents difficulties where the excavator must be positioned at the top of the cliff to cut downwards. Further, to cut horizontally into a cliff wall, or to cut in a horizontal plane or any angle plane other than a plane which is vertical with respect to the excavator arm, is not possible with presently known mounting arrangements.

The present invention provides an articulating mounting arrangement for an excavator, the arrangement comprising a linkage having a first end and a second end, the first end being adapted to be coupled to an arm of the excavator and the second end being adapted to mount a tool, the linkage being articulating to enable the second end to be moved to a plurality of positions relative to the first end, whereby to reposition the tool in any one of a plurality of orientations with respect to the excavator arm.

The term "excavator" is intended to encompass any heavy plant machine and is not limited to a conventional excavator.

The articulating mounting arrangement may be permanently fixed to the excavator arm, although it is preferred that it is detachable.

Securement means are preferably provided to secure the second end in at least predetermined ones of the plurality of positions.

The linkage preferably comprises a plurality of link members pivotally coupled together in sequence. Adjacent members may be locked in predetermined attitudes with respect to each other by a locking means, acting as the securement means referred to above.

The preferred embodiment includes three link members, a first link member adapted to be attached to the end of the excavator arm; an intermediate link member pivotally coupled to the first link member, and a second link member pivotally coupled to the intermediate link member. The second link member is adapted to carry a tool. In an alternative embodiment, however, only two link members may be provided, a first and second link member, pivotally coupled together.

In the preferred embodiment the second member is preferably moveable through a plurality of orientations with respect to the intermediate member and the intermediate member is also moveable through a plurality of orientations with respect to the first member providing increased freedom of movement of the tool with respect to the excavator arm.

In the preferred embodiment, the first member includes a bracket arrangement pivotally mounting the intermediate member so that the intermediate member is pivotable about a first axis with respect to the first member. The intermediate member includes a further bracket arrangement which pivotally mounts the second member so that the second member is pivotable with respect to the intermediate member about a second axis. The second axis is perpendicular to the first axis. The orientation of the intermediate member can preferably be fixed with respect to the first member and the orientation of the second member can preferably be fixed with respect to the intermediate member.

Preferably, locking pins and corresponding receiving passageways in the members are provided to enable the mechanical fixing of the members at predetermined orientations.

Preferably, a hydraulic or other type of motor is provided to drive the rock saw or other tool and is mounted in a cradle in the second member.

The present invention, in at least a preferred embodiment, has the advantage that a the tool can be positioned at any angle relative to the excavator. Where the tool is a rock saw, it can be positioned to make cuts in any dimensional plane at any angle.

Features and advantages of the present invention will become apparent from the following description of an embodiment thereof, by way of example only, with reference to the accompanying drawings, in which.

Figure 1:
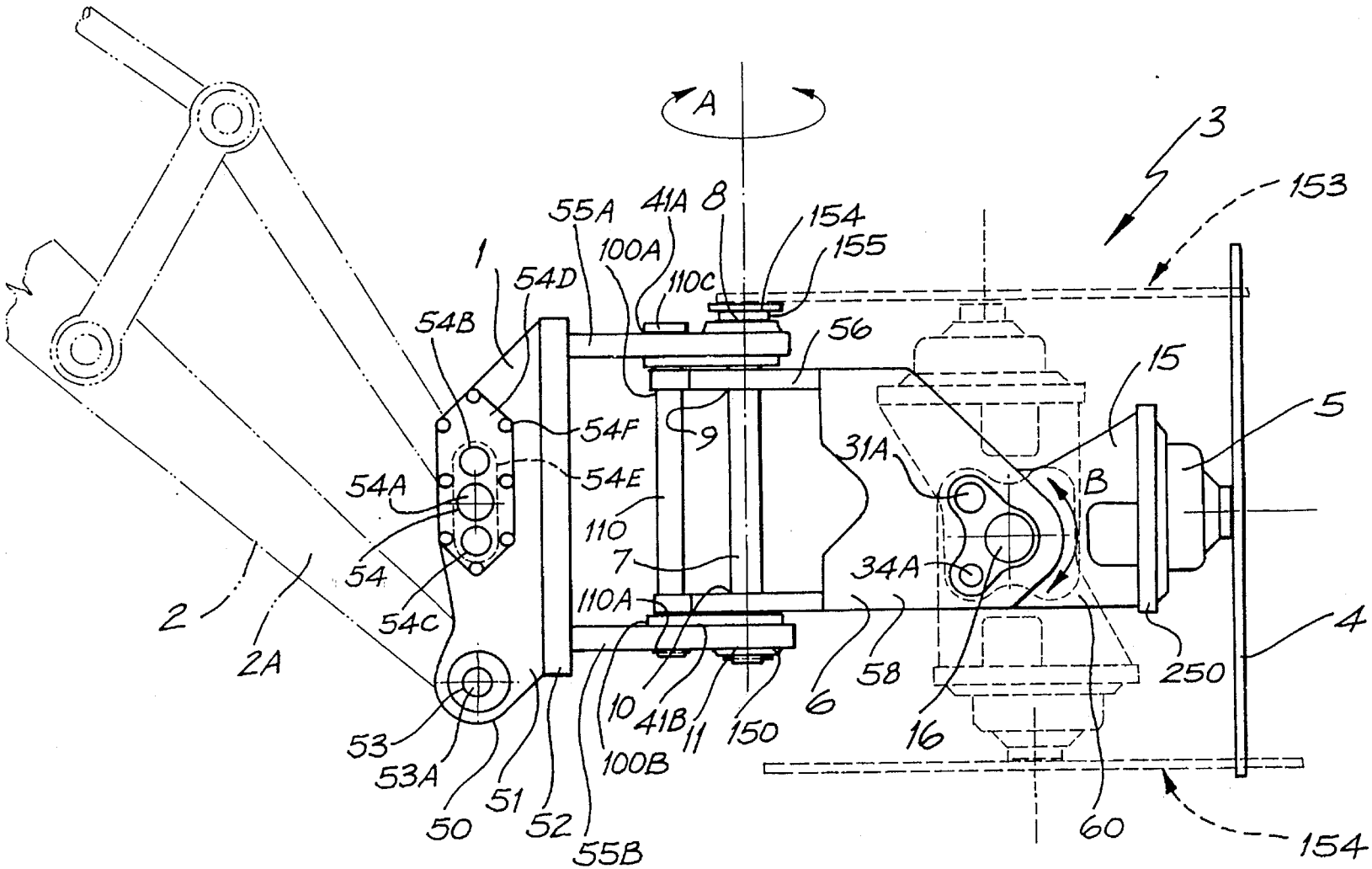
FIG. 1 is a view from the side of an articulating mounting arrangement in accordance with an embodiment of the present invention.
Figure 2:
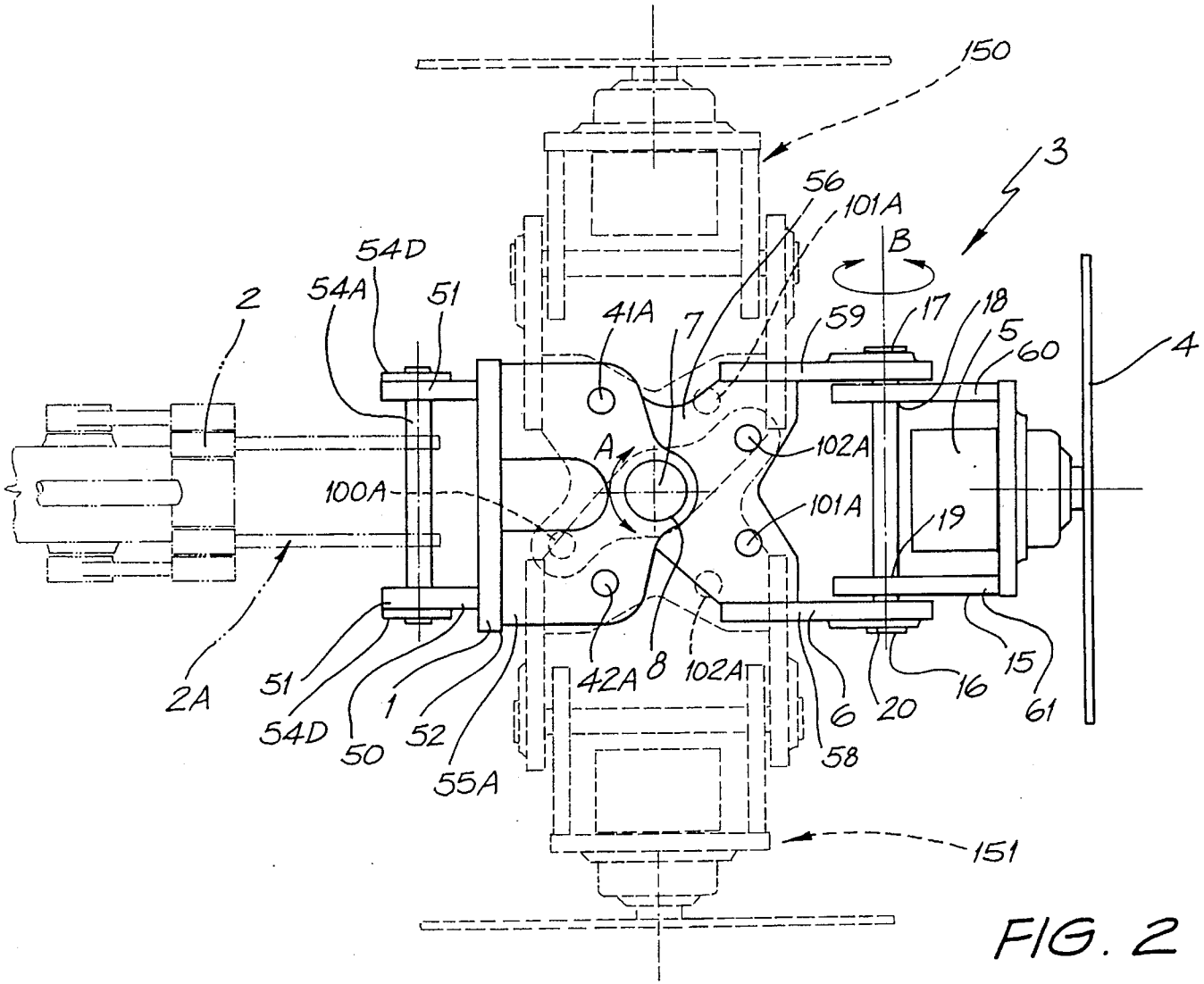
FIG. 2 is a view from above of the arrangement of FIG. 1.

The arrangement 3 comprises a plurality of link members, 1,6 and 15 mounted at one end thereof to a hydraulic arm of a conventional excavator. The end portion of the hydraulic arm is indicated by reference numeral 2, and drawn only schematically in ghost outline. It comprises a plurality of hydraulically driven beams and rods connected together and arranged to mount an operating tool at the end 2A of the arm 2. This arrangement will not be described, as it is an arrangement well known to a skilled person and does not form part of the present invention. At the distal end of the articulating arrangement 3, a rock saw blade 4 (only shown schematically) is mounted, together with hydraulic drive motor 5 (only shown schematically as a block). The articulating arrangement enables three degrees of freedom of movement of the blade 4.

In more detail, the arrangement includes a first link member 1, comprising a mounting bracket 50 having flanges 51 connected by a cross member 52, flanges 51 are provided with passages 53, 54 for receiving respective pins 53A, 54A to mount the member 1 to the excavator arm 2. Further passageways 54B, 54C are provided to enable the member 1 to be mounted to excavator arms 2 of different sizes or to the same excavator arm 2 but with different orientations. A mounting plate 54D is mounted to the bracket 50. The mounting plate 54D has the passageways 54, 54B and 54C formed in it. Ghost line 54E indicates an oval cut-out in flange 51 (a similar cut-out is provided in the opposite flange 51) which cooperates with the passageways 54B, 54C and 54. The mounting plate 54D is fixed to the flange 51 by rivets 54F. The member 1 also includes a further pair of parallel flanges 55A, 55B extending away from the bracket 50. An intermediate link member 6 is pivotally mounted to the member 1 by a pivot pin 7 which extends through passageways 8 and 11 in the flanges 54A and 55B and passageways 9 and 10 in flanges 56 and 57 respectively of the intermediate member 6. The intermediate member 6 may therefore be rotated about the pin 7 on an axis A relative to the first member 1.

The intermediate member 6 is also provided with side plates 58 and 59 extending away from the excavator arm 2. A further pivot pin 16 passes through passageways 17 and 20 in side portions 58 and 59 and also passageways 18 and 19 in flanges 60 and 61 of a second link member 15. The second member 15 is therefore moveable about pin 16 relative to the intermediate member 6 about an axis B.

Axis B is perpendicular to axis A, enabling the saw 4 to be positioned to make cuts within any dimensional plane relative to the excavator.

The respective adjacent link members 1, 6 and 15 are therefore pivotable with respect to each other to vary the attitude of the saw mounted to the member 15, with respect to the member 1 and the excavator arm 2. Securement means are provided to secure the adjacent link members in predetermined attitudes relative to each other. Referring to the drawings, and in particular to FIGS. 1, 2, 4 and 5 securement means applied in this particular embodiment will now be described.

Firstly, locking means for fixing the attitude of intermediate member 6 with respect to first member 1 will be described. Passageways 100A, 101A, 102A (shown in ghost outline in FIG. 4) are provided in flange 56 of intermediate member 6 (passageway reference numerals are shown only in FIGS. 4 and 5, for clarity). Corresponding passageways 100B, 101B, 102B are provided in flange 57 in-line with the corresponding passageways in flange 56. Cooperating passageways are provided in the flanges 54A and 54B of the first link member 1. The cooperating passages in flange 54A are designated with a reference numeral 41A and 42A in FIG. 2. It will be appreciated that corresponding passages 41B, 42B on the other flange 54B are provided in line with the passageways 41A and 42A, but these are not shown on the drawing.

Utilising the cooperating passageways reference numeraled above, the intermediate member 6 may be locked in three attitudes with respect to the first member 1.

The first attitude is shown in FIG. 1, where the intermediate member 6 is in-line with the first member 1. In the in-line attitude, passages 100A and 100B line up with passages 41A and 41B. A locking pin 110, shown in FIG. 1, is passed through the respective passageways to maintain the passageways in-line with each other and to maintain the intermediate member 6 in the in-line attitude with respect to first member 1.

To change the attitude of intermediate member 6 with respect to first member 1, pin 110 is first removed to enable rotation of the intermediate member 6 about the pivoting axis A. Lining up the respective passageways 101A, 101B or 102A, 102B with the passageways 41A, 41B or 42A, 42B provides the relative orientations indicated in ghost outline in FIG. 2 and designated by reference numerals 150, 151 respectively.

A similar mechanism is used to fix the orientation of the second member 15 with respect to the intermediate member 6. In-line passageways 103A, 103B and 104A, 104B in the flanges 60 and 61 of second member 15 are arranged to cooperate with passageways 31A, 34A and 31B, 34B (not shown, but it will be appreciated that they are in-line with passageways 31A and 34B), in order to fix the respective attitudes of second member 15 with respect to intermediate member 6 as shown in FIG. 1. The in-line attitude is indicated in bold lines, and respective perpendicular attitudes are indicated in ghost line and designated by reference numeral 153, 154 respectively. A locking pin or pins 110 is used to fix the respective members in the chosen attitude. Note that in the in-line attitude two pins may be used, although this is not necessary, as all the passageways line up. In attitude 153, passageways 103A, 103B, 34A, 34B, line up and in attitude 154, passageways 104A, 104B, 31A, 31B, line up.

Figure 3:
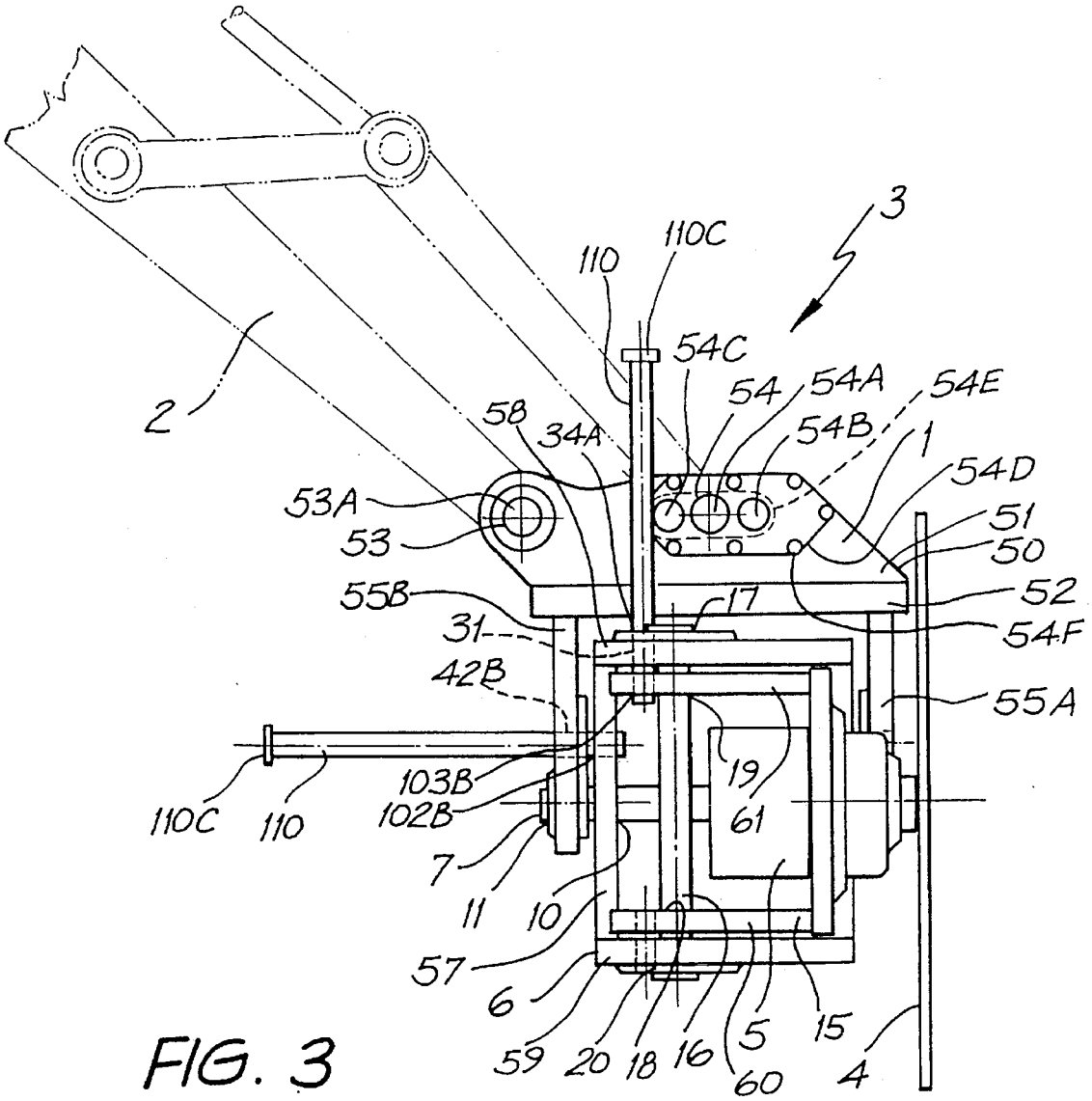
FIG. 3 is a further view from the side of the articulating mounting arrangement of FIG. 1, showing the arrangement in one of its operating positions.

FIG. 3 shows the arrangement in one operating position. In this position, the saw 4 lies in a plane which runs perpendicular to the plane which the excavator arm 2 lies in. The saw is also positioned to one side of the excavator arm 2. Pins 110 are shown only partially inserted in the respective passageways. In operation they would be fully inserted all the way through both sets of flanges on each link member.

Figure 4:
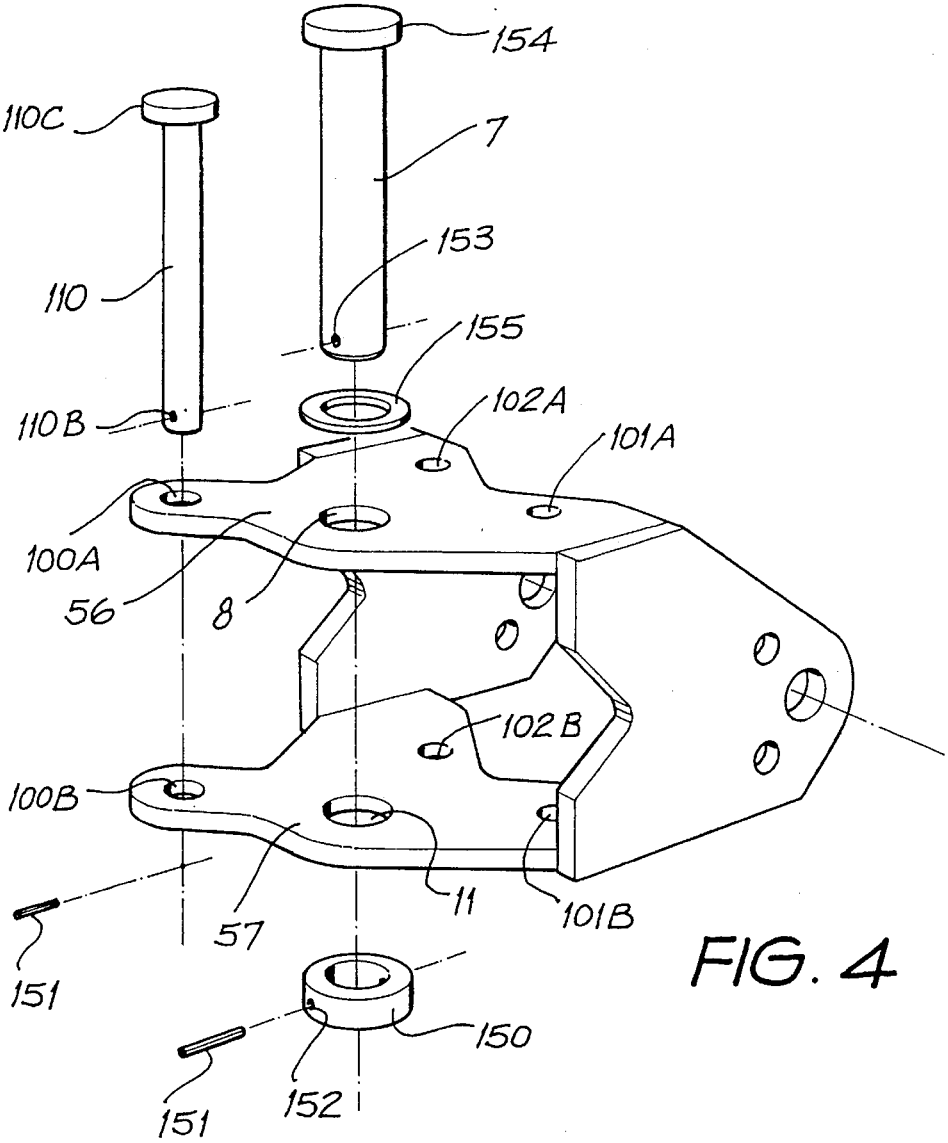
FIG. 4 is a perspective view of the intermediate link member disconnected from the arrangement.
Figure 5:
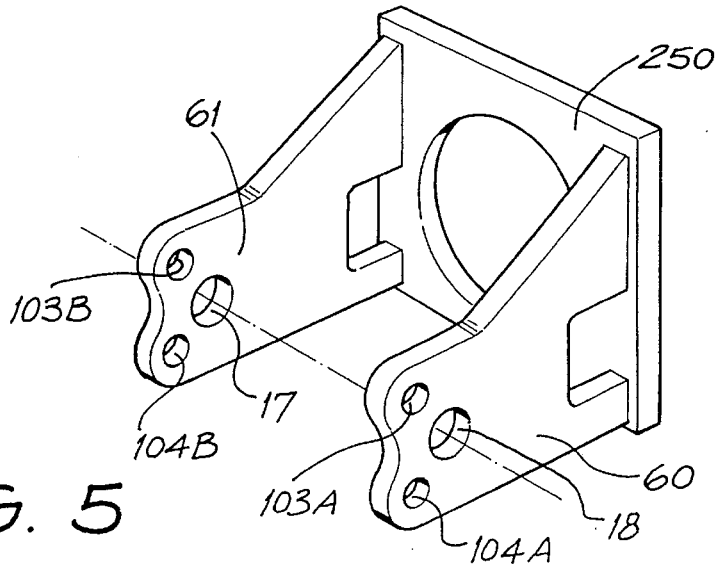
FIG. 5 is a perspective view of the second link member disconnected from the arrangement, with drive motor and rock saw tool dismounted.

FIG. 4 also illustrates how the pivot pins and locking pins are fixed within the respective passageways. Pivot pin 7 is fixed through passageways 8, 9, 10 and 11 in flanges 55A and 55B and retained by a retaining flange 150 which fits over the extreme end of the pivot pin 7. The pivot pin 7 is received in passageway 7A in bush 150. A roll pin 151 fits through a passageway 152 in the flange 150 and cooperating passageway 153 in the pivot pin 7 to retain the pivot pin in place. At the opposite end of the pivot pin 7, a flat head 154 and steel bush 155 prevent lateral motion of the pivot pin. A similar arrangement (not illustrated) is used for pivot pin 16. Each locking pin 110 (one example only illustrated in FIG. 4) is inserted through the cooperating holes and fixed by a separate roll pin 110A fitting into passageway 110B in pin 110, the flattened head 110C retains the other end of the pivot pin 110.

Together with the movement which may be provided by the hydraulic arm, it will be appreciated that a rock saw can be fixed in any orientation with respect to the excavator carrying the saw. For example, it can be positioned to cut downwardly into the ground along a line perpendicular to the arm 2 or along a line parallel to the arm 2. It can also be positioned to cut horizontally into a rock face.

It will be appreciated that, while only a number of fixed positions are shown available in the described embodiment, means may be provided to fix the members with respect to each other in any number of orientations. For example, more holes could be provided than are shown in this particular embodiment, for receiving pins. Other mechanisms could also be used to fix relative orientation of the arrangement.

A rock saw is not the only tool which can be mounted in an arrangement in accordance with the present invention. The arrangement may be used to mount other tools. For example, a drill may be mounted by the second member. In this case, the articulating mounting arrangement can be used to act as a "pendulum" to ensure that the drill is pointing vertically downwards at all times. In that case, no pins would be used to fix any respective orientation of the arrangement, but the arrangement is allowed to hang freely. Of course, orientations may be fixed for a drill, if drilling is required at different angles. The motor and bearing for the saw are mounted on a cross member 250 which forms part of member 15. The motor and bearing may be mounted to the cross member 250 in any appropriate manner.

Other tools which may be used with an articulating mounting arrangement in accordance with the present invention include an auger, a rock grinder and others. The person skilled in the art will be able to design the appropriate mounting for each tool.

In an alternative embodiment only two link members may be utilised. For example, the intermediate link member of the described embodiment, 6, may be removed and the second link member 15 coupled directly to the first link member 1. This would not provide as many available orientations, but will still have a number of useful applications.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. An articulating mounting arrangement for an excavator, the arrangement comprising a linkage having a first end and a second end, the first end being adapted to be coupled to an arm of the excavator and the second end being adapted to mount a tool, the linkage being articulating to enable the second end to be moved to a plurality of positions relative to the first end to position the tool in any one of a plurality of orientations with respect to the excavator arm, the linkage comprising a plurality of discrete link members pivotally coupled together in sequence, for pivotable motion with respect to each other, and comprising securement means including a locking means arranged to lock adjacent links in a predetermined one of a plurality of attitudes with respect to each other to secure the second end in at least predetermined ones of the plurality of positions, wherein the locking means comprise first and second cooperating passages in adjacent links and a locking pin arranged to be inserted through the cooperating passages when the links are positioned in the predetermined attitude, to lock the cooperating passages in-line.

2. An articulating mounting arrangement in accordance with claim 1, wherein each adjacent link has a plurality of said first and second cooperating passages to enable the adjacent links to be locked in said predetermined one of said plurality of attitudes with respect to each other.

3. An articulating mounting arrangement in accordance with claim 1, wherein the plurality of link members comprise a first link member adapted to be mounted to the excavator arm, and a second link member pivotally mounted to the first link member to pivot with respect to the first link member about a first axis, the second link member being adapted to mount said tool.

4. An articulating mounting arrangement in accordance with claim 1, wherein the plurality of link members comprise a first member adapted to be mounted to the end of the excavator arm, an intermediate member pivotally coupled to the first member so as to be pivotable relative thereto about a first axis, and a second member pivotally coupled to the intermediate member so as to be pivotable relative thereto about a second axis, the second member being adapted to mount said tool.

5. An articulating mounting arrangement in accordance with claim 4, wherein the first axis and the second axis are perpendicular to each other.

6. An articulating mounting arrangement in accordance with claim 4, wherein the second member is arranged to mount a motor to drive said tool.

7. An excavator with an articulating mounting arrangement adapted to carry a powered tool, the arrangement comprising a linkage having a first end and a second end, the first end being adapted to be coupled to an arm of the excavator and the second end being adapted to mount said powered tool, the linkage being articulating to enable the second end to be moved to a plurality of positions relative to the first end to position said tool in any one of a plurality of orientations with respect to the excavator arm, the linkage comprising a plurality of discrete link members pivotally coupled together in sequence, for pivotable motion with respect to each other, and comprising securement means including a locking means arranged to lock adjacent links in a predetermined one of a plurality of attitudes with respect to each other to secure the second end in at least predetermined ones of said plurality of positions, wherein said locking means comprise first and second cooperating passages in adjacent links and a locking pin arranged to be inserted through said first and second cooperating passages when said links are positioned in said predetermined attitude, to lock said first and second cooperating passages in-line.

8. An excavator in accordance with claim 7, wherein each said adjacent link has a plurality of said first and second cooperating passages to enable said adjacent links to be locked in said predetermined one of said plurality of attitudes with respect to each other.

9. An excavator in accordance with claim 7, wherein said plurality of link members comprise a first member adapted to be mounted to the end of said excavator arm, an intermediate member pivotally coupled to said first member so as to be pivotable relative thereto about a first axis, and a second member pivotally coupled to said intermediate member so as to be pivotable relative thereto about a second axis, said second member being adapted to mount said tool.

10. An excavator in accordance with claim 9, wherein said first axis and said second axis are perpendicular to one another.

11. An excavator in accordance with claim 10, wherein said powered tool is a rock saw and said second member is arranged to mount the motor of said rock saw.

* * * * *